US010446343B2

(12) United States Patent
Taga et al.

(10) Patent No.: US 10,446,343 B2
(45) Date of Patent: Oct. 15, 2019

(54) KEY SWITCH AND KEYBOARD

(71) Applicant: FUJITSU COMPONENT LIMITED, Tokyo (JP)

(72) Inventors: Daisuke Taga, Tokyo (JP); Momosuke Nakahara, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 15/738,825

(22) PCT Filed: Jun. 9, 2016

(86) PCT No.: PCT/JP2016/067208
§ 371 (c)(1),
(2) Date: Dec. 21, 2017

(87) PCT Pub. No.: WO2017/002572
PCT Pub. Date: Jan. 5, 2017

(65) Prior Publication Data

US 2018/0190448 A1 Jul. 5, 2018

(30) Foreign Application Priority Data

Jul. 1, 2015 (JP) ..... 2015-133045

(51) Int. Cl.
*H01H 1/00* (2006.01)
*H01H 13/48* (2006.01)
(Continued)

(52) U.S. Cl.
CPC ..... *H01H 13/803* (2013.01); *H01H 5/30* (2013.01); *H01H 13/48* (2013.01); *H01H 13/52* (2013.01);
(Continued)

(58) Field of Classification Search
CPC ..... H01H 5/30; H01H 13/48; H01H 13/7073; H01H 2215/036
See application file for complete search history.

(56) References Cited

U.S. PATENT DOCUMENTS 3,856,998 A * 12/1974 Sims, Jr. ..... H01H 13/52 200/5 A
6,297,461 B1 10/2001 Kamishima
(Continued)

FOREIGN PATENT DOCUMENTS

CN 203826263 U 9/2014
JP S59-121719 7/1984
(Continued)

OTHER PUBLICATIONS

International Search Report dated Aug. 23, 2016 with respect to PCT/JP2016/067208.

*Primary Examiner* — Vanessa Girardi
(74) *Attorney, Agent, or Firm* — IPUSA, PLLC

(57) ABSTRACT

A key switch includes a movable part configured to be moved by a pressing operation, a support mechanism that movably supports the movable part, an electrical connector including multiple pairs of contacts of upper electrodes and lower electrodes, and a disc spring that is disposed between the movable part and the electrical connector and configured to be elastically deformed by movement of the movable part and to press the electrical connector. The multiple pairs of contacts are provided for one movable part. When the disc spring is deformed by the movement of the movable part, the disc spring is configured to simultaneously press the multiple pairs of contacts provided for the corresponding movable part.

5 Claims, 10 Drawing Sheets

(51) Int. Cl.

| | |
|---|---|
| ***H01H 13/79*** | (2006.01) |
| ***H01H 13/803*** | (2006.01) |
| ***H01H 5/30*** | (2006.01) |
| ***H01H 13/52*** | (2006.01) |
| ***H01H 13/7073*** | (2006.01) |
| ***H01H 13/807*** | (2006.01) |
| *H01H 13/703* | (2006.01) |

(52) U.S. Cl.
CPC ..... *H01H 13/7073* (2013.01); *H01H 13/79* (2013.01); *H01H 13/807* (2013.01); *H01H 13/703* (2013.01); *H01H 2001/0005* (2013.01); *H01H 2203/02* (2013.01); *H01H 2215/036* (2013.01); *H01H 2221/058* (2013.01); *H01H 2225/01* (2013.01)

(56) References Cited

U.S. PATENT DOCUMENTS

| | | | | |
|---|---|---|---|---|
| 6,700,508 | B1 * | 3/2004 | Nomura | H01H 13/702 341/22 |
| 2003/0169232 | A1 | 9/2003 | Ito | |
| 2014/0339065 | A1 * | 11/2014 | Ohtsuka | H01H 3/125 200/5 A |

FOREIGN PATENT DOCUMENTS

| | | |
|---|---|---|
| JP | H04-259714 | 9/1992 |
| JP | 2001-076584 | 3/2001 |
| JP | 2003-263257 | 9/2003 |
| JP | 2007-179921 | 7/2007 |
| JP | 2014-220130 | 11/2014 |
| JP | 2014-222644 | 11/2014 |
| WO | 01/044917 | 6/2001 |

* cited by examiner

KEY SWITCH AND KEYBOARD

TECHNICAL FIELD

The present invention relates to a key switch and a keyboard.

BACKGROUND ART

A keyboard including multiple key switches is known as one type of information input device used, for example, for a computer.

A known key switch includes a support mechanism that supports a key top to be pressed, a rubber cup that elastically biases the key top upward, and a membrane switch including contacts that are pressed and connected to each other when the key top is pressed (Patent Document 1).

RELATED-ART DOCUMENT

Patent Document

[Patent Document 1] Japanese Laid-Open Patent Publication No. 2003-263257

SUMMARY OF INVENTION

Technical Problem

When a key switch includes two pairs of contacts that are intended to be turned on at the same time when a key top is pressed, the two pairs of contacts may not be reliably turned on because the force and manner of pressing the key top vary depending on operators.

One exemplary object according to an aspect of the present invention is to provide a key switch and a keyboard configured such that multiple pairs of contacts can be reliably turned on.

Solution to Problem

According to an aspect of the present invention, a key switch includes a movable part configured to be moved by a pressing operation, a support mechanism that movably supports the movable part, an electrical connector including multiple pairs of contacts of upper electrodes and lower electrodes, and a disc spring that is disposed between the movable part and the electrical connector and configured to be elastically deformed by movement of the movable part and to press the electrical connector. The multiple pairs of contacts are provided for one movable part. When the disc spring is deformed by the movement of the movable part, the disc spring is configured to simultaneously press the multiple pairs of contacts provided for the corresponding movable part.

Advantageous Effects of Invention

An aspect of the present invention makes it possible to reliably turn on multiple pairs of contacts.

DESCRIPTION OF EMBODIMENTS

Non-limiting embodiments of the present invention are described below with reference to the accompanying drawings.

Throughout the accompanying drawings, the same or corresponding reference numbers are assigned to the same or corresponding components, and repeated descriptions of those components are omitted. Unless otherwise mentioned, the drawings do not indicate relative sizes of components. A person skilled in the art may determine actual sizes of components taking into account the embodiments described below.

The embodiments described below are examples, and the present invention is not limited to those embodiments. Also, not all of the features and their combinations described in the embodiments may be essential to the present invention.

FIGS. 1 through 4 illustrate a key switch and a keyboard including multiple key switches according to an embodiment.

Figure 1:
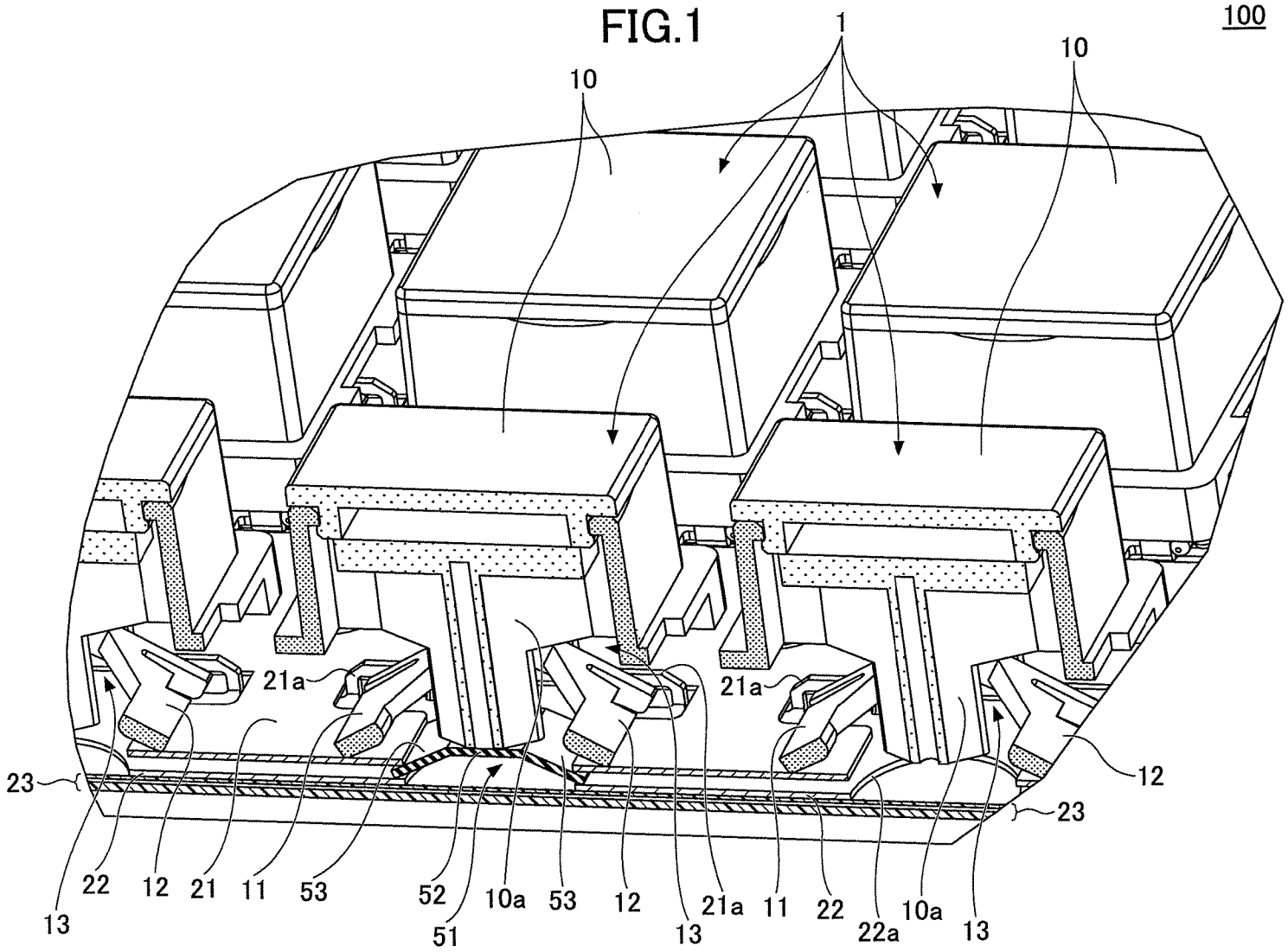
FIG. 1 is a perspective view of key switches and a keyboard according to an embodiment.
Figure 2:
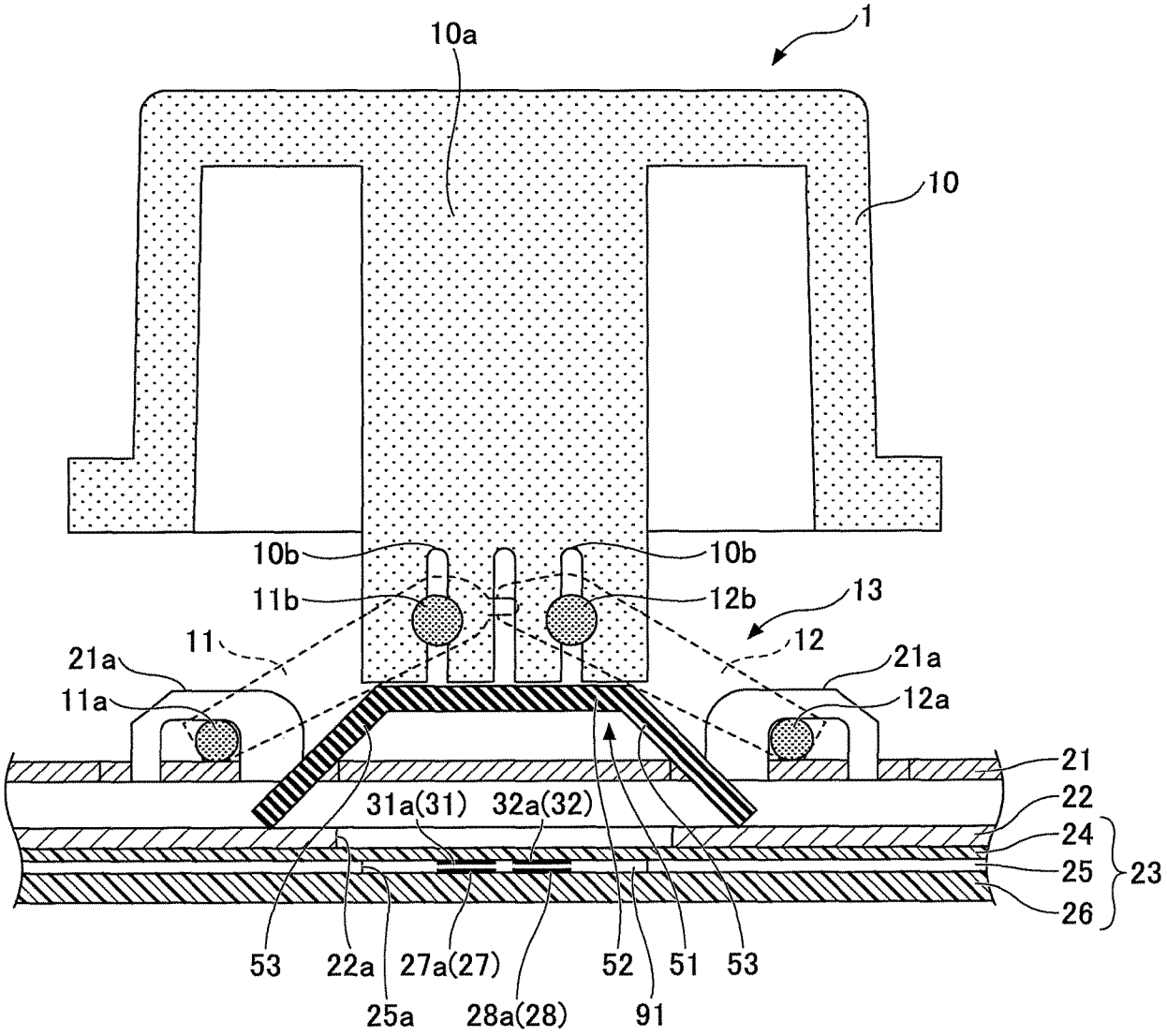
FIG. 2 is a first cross-sectional view of a key switch according to an embodiment.
Figure 3:
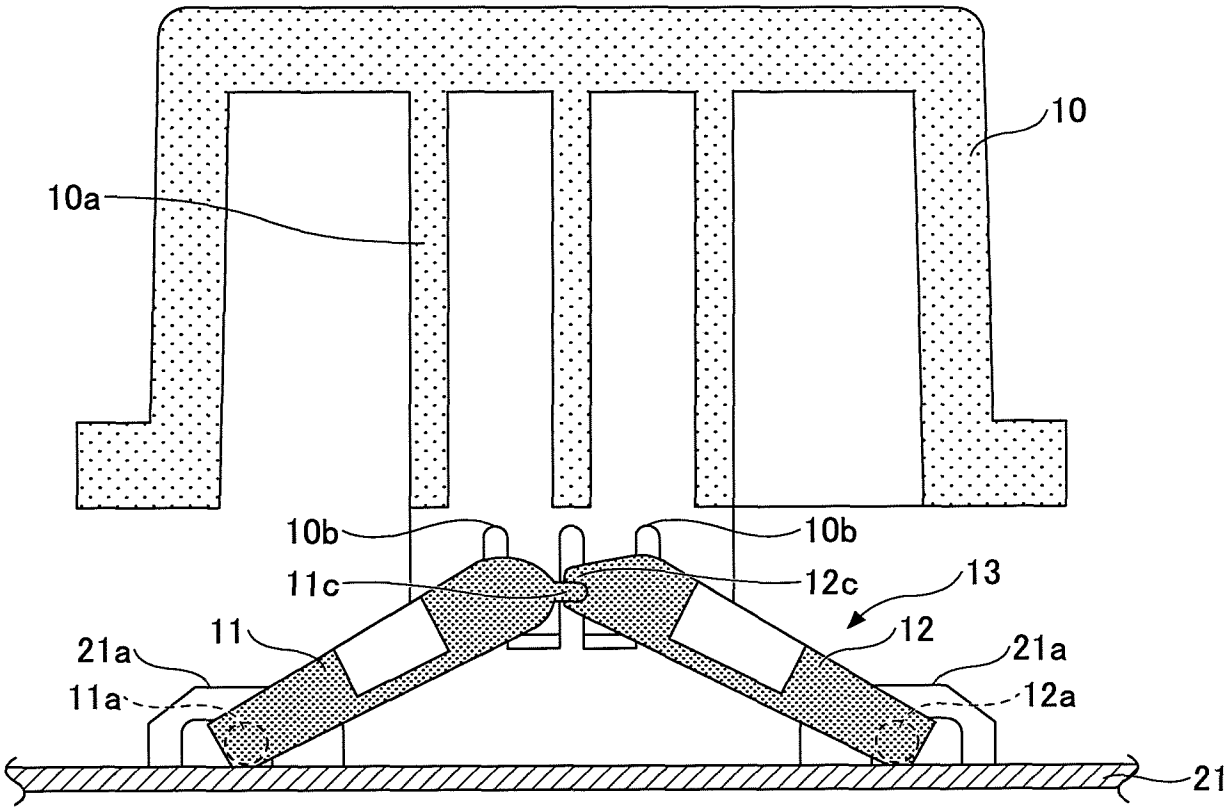
FIG. 3 is a second cross-sectional view of a key switch according to an embodiment.
Figure 4:
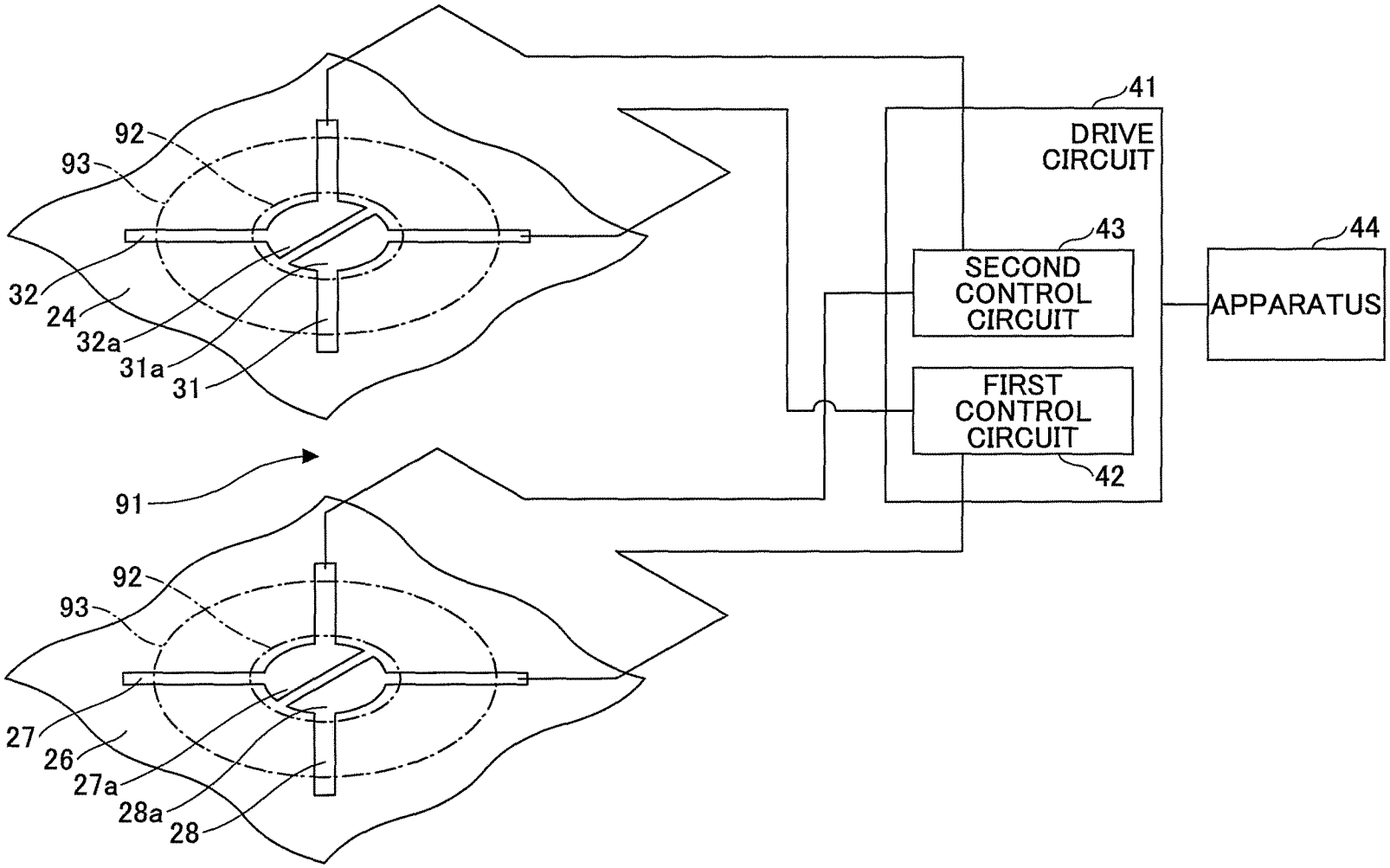
FIG. 4 is a drawing illustrating electrode patterns on a membrane sheet and a drive circuit.

FIG. 1 is an enlarged view of a part of a keyboard 100. FIG. 2 is a cross-sectional view of a key switch 1 taken along a line corresponding to a position where a key top 10 is connected to linking parts 11 and 12. FIG. 3 is a cross-sectional view of the key switch 1 taken along a line corresponding to a position where teeth 11*c* and 12*c* of the linking parts 11 and 12 engage with each other. FIG. 4 illustrates lower electrodes 27 and 28 and upper electrodes 31 and 32 that are formed on a membrane sheet 23, and a drive circuit 41 to which the membrane sheet 23 is connected.

The keyboard 100 includes key switches 1, a base 21, a support 22, and the membrane sheet 23.

The key switches 1 are attached to the base 21. The base 21 is a metal plate and has a strength that is sufficient to hold the key switches 1. Frames 21*a* for supporting the linking parts 11 and 12 are formed on a surface of the base 21.

Each key switch 1 includes a key top 10 to be operated by an operator, a gear link mechanism 13 that supports the key top 10 such that the key top 10 is movable in a vertical direction, the membrane sheet 23 including a switch that opens and closes when pressed by the key top 10, and a disc spring 51 that biases the key top 10 in a direction away from the base 21.

The key top 10 includes a pressing part 10*a* that is in contact with the disc spring 51 and presses the disc spring 51. The pressing part 10*a* is disposed in an inner central region of the key top 10. The pressing part 10*a* includes insertion parts 10*b* that are slits formed in an end portion of the pressing part 10*a*.

The gear link mechanism 13 is an example of a support mechanism and includes two linking parts 11 and 12. The key top 10 is supported on the base 21 by the linking parts 11 and 12. The linking parts 11 and 12, respectively, include sliding shafts 11*a* and 12*a* at first ends and rotational shafts 11*b* and 12*b* at second ends.

The sliding shafts 11*a* and 12*a* of the linking parts 11 and 12 are inserted into the frames 21*a* of the base 21, and are supported by the frames 21*a* so as to be slidable along the surface of the base 21. The rotational shafts 11*b* and 12*b* are inserted into the insertion parts 10*b* formed in the pressing part 10*a* and are rotatably supported by the insertion parts 10*b*.

Also, as illustrated in FIG. 3, the teeth 11*c* and 12*c* are formed at the second ends of the linking parts 11 and 12 where the rotational shafts 11*b* and 12*b* are formed. The tooth 11*c* and the tooth 12*c* are engaged with each other so that the linking part 11 and the linking part 12 move along with each other.

As illustrated in FIG. 2, the membrane sheet 23 is disposed below the support 22, and includes an upper layer 24, a lower layer 26, and a spacer 25.

Each of the upper layer 24 and the lower layer 26 is formed of polyethylene terephthalate (PET). Upper electrodes 31 and 32 are printed on the upper layer 24 and lower electrodes 27 and 28 are printed on the lower layer 26 by using a conductive paste.

The spacer 25 forms a gap between the upper layer 24 and the lower layer 26. The spacer 25 includes a hole 25*a* in a position facing the disc spring 51 to form a gap 91 between the upper layer 24 and the lower layer 26.

In an area of the lower layer 26 corresponding to the gap 91, a contact 27*a* of the lower electrode 27 and a contact 28*a* of the lower electrode 28 are formed. In an area of the upper layer 24 corresponding to the gap 91, a contact 31*a* of the upper electrode 31 and a contact 32*a* of the upper electrode 32 are formed. As illustrated in FIG. 4, each of the contacts 27*a*, 28*a*, 31*a*, and 32*a* has a semicircular shape in plan view.

The contacts 27*a*, 28*a*, 31*a*, and 32*a* are disposed in an area 92 of the membrane sheet 23 that is to be pressed by the disc spring 51. The contacts 27*a* and 32*a* face each other in the vertical direction, and the contacts 28*a* and 31*a* face each other in the vertical direction. The contact 27*a* of the lower electrode 27 and the contact 32*a* of the upper electrode 32 form one pair of contacts, and the contact 28*a* of the lower electrode 28 and the contact 31*a* of the upper electrode 31 form one pair of contacts.

With the contacts 27*a*, 28*a*, 31*a*, and 32*a* formed as described above, the membrane sheet 23 is configured such that two pairs of contacts are provided for one disc spring 51 (or one key tope 10). Thus, with the key switch 1 of the present embodiment, the pair of the contact 27*a* of the lower electrode 27 and the contact 32*a* of the upper electrode 32 and the pair of the contact 28*a* of the lower electrode 28 and the contact 31*a* of the upper electrode 31 are simultaneously turned on when the key top 10 is operated.

The lower electrodes 27 and 28 and the upper electrodes 31 and 32 of the membrane sheet 23 are connected to the drive circuit 41. The drive circuit 41 is connected to an apparatus 44 such as a personal computer.

The drive circuit 41 includes a first control circuit 42 connected to the lower electrode 28 and the upper electrode 31, and a second control circuit 43 connected to the lower electrode 27 and the upper electrode 32. In the present embodiment, the first control circuit 42 and the second control circuit 43 are mutually-independent electric circuits. For example, the drive circuit 41 outputs a signal to the apparatus 44 when a control signal output by the first control circuit 42 and a control signal output by the second control circuit 43 are identical to each other. However, the method of outputting a signal is not limited to this example.

The disc spring 51 is disposed between the membrane sheet 23 and the key top 10. More specifically, the disc spring 51 is disposed between the support 22 disposed on the membrane sheet 23 and the lower surface of the pressing part 10*a*.

The disc spring 51 includes a pressed part 52 and a skirt part 53. The pressed part 52 is in contact with the pressing part 10*a* of the key top 10, and is located in the middle of the disc spring 51. The skirt part 53 buckles when the pressed part 52 is pressed and a load is applied to the disc spring 51. The skirt part 53 is shaped like a skirt and extends from the periphery of the pressed part 52 toward the support 22.

Next, workings of the key switch 1 are described with reference to FIGS. 1 through 6.

When the key top 10 is pressed by an operator in a state as illustrated in FIGS. 1 through 3 and 5, the key top 10 moves toward the membrane sheet 23. As the key top 10 moves, the rotational shafts 11*b* and 12*b* connected to the pressing part 10*a* are pressed by the key top 10, and the linking parts 11 and 12 move. While the linking parts 11 and 12 move, the sliding shafts 11*a* and 12*a* slide horizontally within the frames 21*a*.

As illustrated in FIG. 3, because the tooth 11*c* of the linking part 11 and the tooth 12*c* of the linking part 12 are engaged with each other, when one of the linking parts 11 and 12 moves, the other one of the linking parts 11 and 12 also moves along with the movement of the one of the linking parts 11 and 12. Because the two linking parts 11 and 12 move simultaneously, the key top 10 moves in a direction substantially perpendicular to the base 21.

When the key top 10 is pressed, the pressing part 10*a* presses the pressed part 52 of the disc spring 51. When the key top 10 is pressed a predetermined distance, the disc spring 51 buckles and is reversed upside down, and the pressed part 52 presses the upper layer 24 of the membrane sheet 23.

The area 92 in FIG. 4 indicates an area that is pressed by the pressed part 52 when the disc spring 51 is reversed.

An area 93 in FIG. 4 indicates an area where the hole 25*a* is formed and where the upper layer 24 is deformed when the membrane sheet 23 is pressed. The area 92 is disposed in the middle of the area 93.

When the disc spring 51 buckles and is reversed, the pressed part 52 presses the area 92, and the upper layer 24 is deformed. As a result of the deformation, the pair of the contact 27*a* and the contact 32*a* and the pair of the contact 28*a* and the contact 31*a* are turned on simultaneously.

Pressing characteristics of the key switch 1 using the disc spring 51 are described below. The pressing characteristics of a key switch indicate a relationship between the load of pressing a key top and a stroke (moved distance) of the key top.

Figure 7:
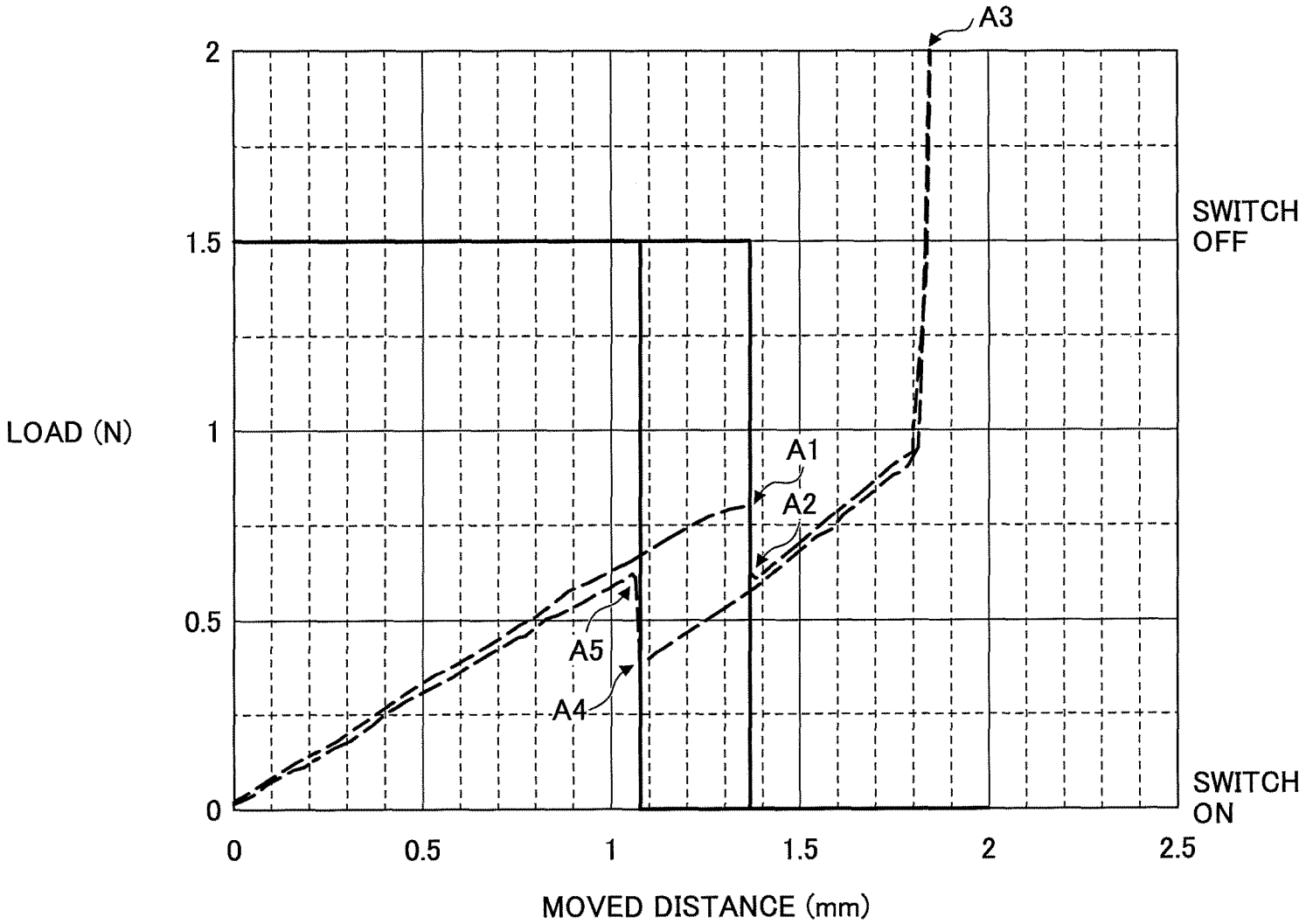
FIG. 7 is a graph illustrating pressing characteristics of a key switch according to an embodiment.
Figure 8:
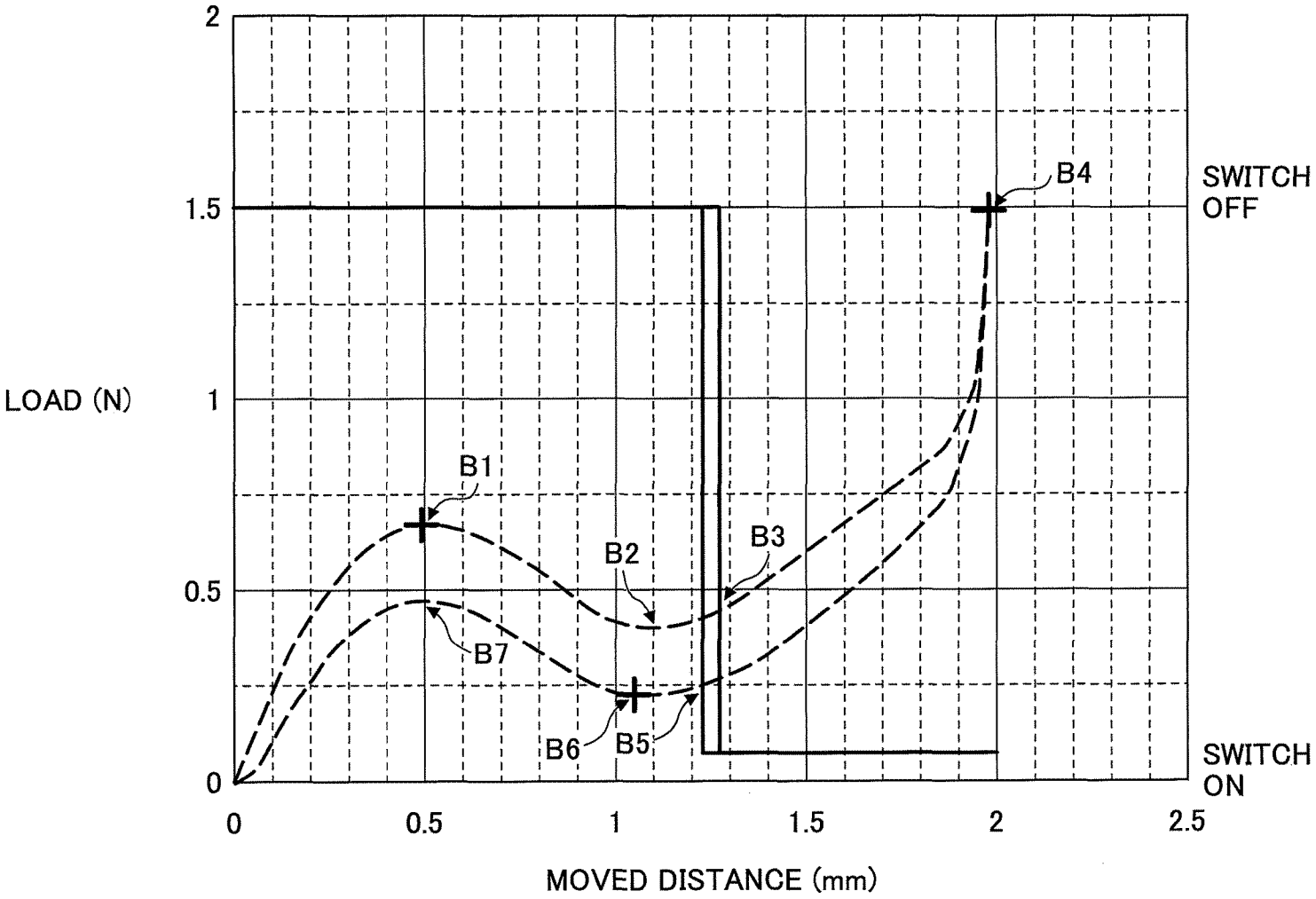
FIG. 8 is a graph illustrating pressing characteristics of a key switch according to a comparative example.

FIG. 7 is a graph illustrating pressing characteristics of the key switch 1 using the disc spring 51. FIG. 8 is a graph illustrating pressing characteristics of a key switch of a comparative example which uses a rubber cup.

In FIGS. 7 and 8, the horizontal axis indicates a moved distance (mm) of a key top, and the vertical axis indicates a load (N). A dotted line indicates the load (N) of pressing the key top at the corresponding moved distance of the key top, and each solid line indicates ON/OFF of a switch of a membrane sheet corresponding to the moved distance of the key top. The moved distance of the key top is measured with reference to an initial position ("0") where the key top is located before being pressed. The ON/OFF of the switch of the membrane sheet indicates a connection state of contacts of the switch. "ON" indicates that the contacts are connected, and "OFF" indicates that the contacts are not connected.

The pressing characteristics obtained while the key top is pressed are different from the pressing characteristics obtained while the key top is pushed back by a disc spring or a rubber cup. Accordingly, as illustrated in FIGS. 7 and 8, the pressing characteristics of a key switch have hysteresis.

First, the pressing characteristics of a key switch using a rubber cup are described with reference to FIG. 8.

When the key top is pressed, the rubber cup is pressed by the key top moving downward, and the rubber cup is elastically deformed. The elastic force of the rubber cup generated by the elastic deformation is applied to the key top and pushes the key top upward. As a result, the pressing load of the key top gradually increases.

In the example of FIG. 8, the rubber cup buckles when the key top reaches a position (B1) corresponding to a moved distance of about 0.50 mm. After the rubber cup buckles, the elastic force applied by the rubber cup to the key top decreases and therefore the load decreases.

When the key top reaches a position (B2) corresponding to a moved distance of about 1.10 mm, the rubber cup contacts the membrane sheet. In this state, the lower electrodes and the upper electrodes of the membrane sheet are still apart from each other, and the pairs of contacts are not turned on.

When the key top is further pressed from this state, the rubber cup presses the membrane sheet, and the upper layer of the membrane sheet is deformed toward the lower layer. When the upper layer is deformed, a force to push the key top upward is generated in the membrane sheet. Accordingly, after the moved distance of the key top exceeds about 1.10 mm, the load to press the key top increases.

As the key top is pressed further, the upper layer is further deformed toward the lower layer, and the upper electrodes contact and are electrically connected to the lower electrodes. In the example of FIG. 8, the upper electrodes and the lower electrodes are connected to each other and the switch is turned on when the key top reaches a position (B3) corresponding to a moved distance of about 1.28 mm.

When the key top is pressed further and the upper layer is deformed up to a deformation limit position, further movement of the key top is prevented. In the example of FIG. 8, the movement of the key top is prevented when the key top reaches a position (B4) corresponding to a moved distance of about 2.00 mm. The moved distance (2.00 mm) at the position B4 corresponds to a stroke of the key top.

When the force pressing the key top is removed and the key top returns to a position (B5) corresponding to a moved distance of about 1.22 mm, the upper electrodes are disconnected from the lower electrodes and the switch is turned off. When the key top reaches a position (B6) corresponding to a moved distance of about 1.50 mm, the rubber cup moves away from the upper layer. When the key top reaches a position (B7) corresponding to a moved distance of about 0.50 mm, the buckled rubber cup is restored to its original shape and the key top returns to its original state before being pressed.

In the case of the key switch using the rubber cup as an elastic part, the moved distance of the key top from a position (B1) where the rubber cup starts to buckle to a position (B3) where the upper electrodes are connected to the lower electrodes is comparatively long. More specifically, the key top moves about 0.78 mm from the position B1 (moved distance is about 0.50 mm) to the position B3 (moved distance is about 1.28 mm). The key top moves from the position B1 to the position B3 as a result of being pressed by an operator.

That is, in the key switch using the rubber cup, the upper electrodes are connected to the lower electrodes by a pressing force of the operator pressing the key top.

However, the force and manner of pressing the key top vary depending on operators. Therefore, with the key switch using the rubber cup, when the operator does not press the key top with a force sufficient to simultaneously turn on the two pairs of contacts or the operator presses a part of the key top that is away from the center of the key top, the two pairs of contacts may not be reliably turned on at the same time. Also, with the key switch using the rubber cup, it is necessary to press the rubber cup by continuously pressing the key top a predetermined distance from a position where the rubber cup starts to deform to a position where the pairs of contacts are turned on. However, when, for example, the manner of applying a force to the key top changes while pressing the key top, the timing when a pair of contacts is turned on may become different from the timing when another pair of contacts is turned on, and the two pairs of contacts may not be turned on simultaneously. Next, the pressing characteristics of the key switch 1 using the disc spring 51 of the present embodiment are described with reference to FIG. 7.

Figure 5:
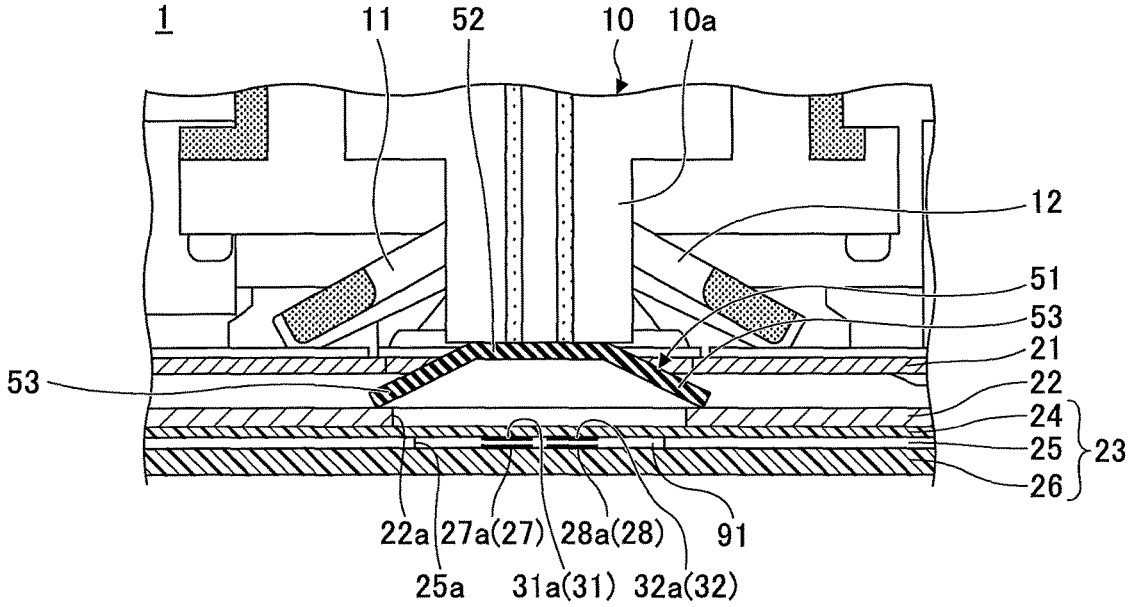
FIG. 5 is a drawing used to describe workings of a key switch according to an embodiment (before operation)

When an operator presses the key top 10 in a state illustrated in FIG. 5, the pressing part 10*a* presses the pressed part 52 of the disc spring 51. As the pressed part 52 is pressed, the disc spring 51 is elastically deformed gradually, and an elastic force generated by the elastic deformation is applied to the key top 10 in a direction opposite the pressing direction in which the key top 10 is pressed. As a result, the load of pressing the key top 10 gradually increases.

Figure 6:
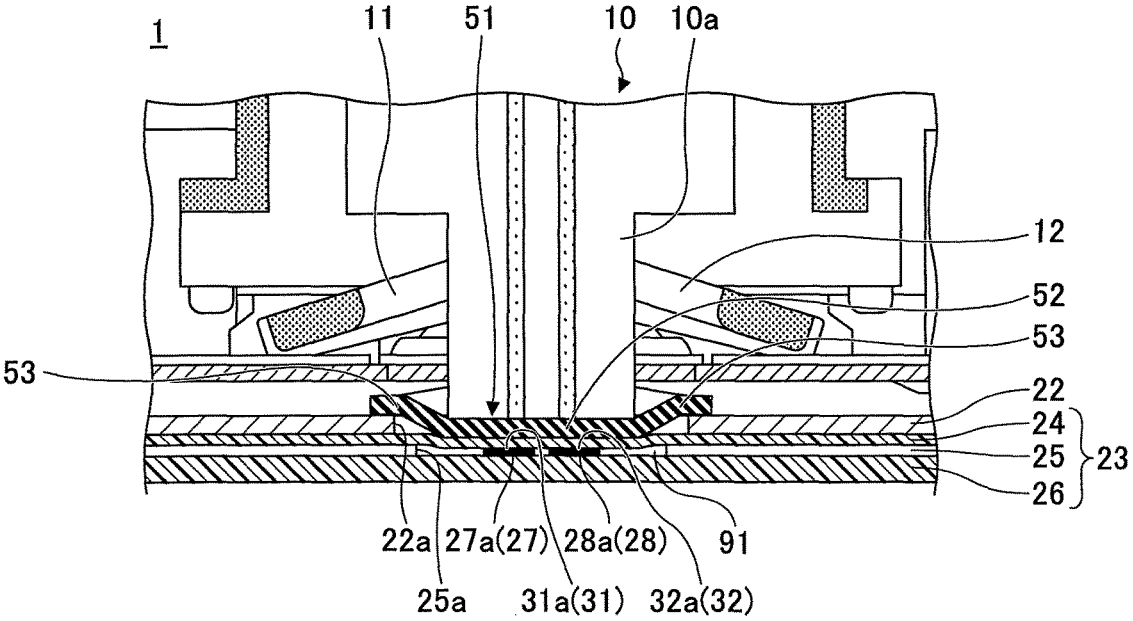
FIG. 6 is a drawing used to describe workings of a key switch according to an embodiment (after operation)

In the example of FIG. 7, the disc spring 51 buckles when the key top 10 reaches a position (A1) corresponding to a moved distance of about 1.38 mm. FIG. 6 illustrates the disc spring 51 that has buckled.

When the disc spring 51 buckles, the pressed part 52 initially protruding upward toward the pressing part 10*a* in FIG. 5 protrudes downward toward the membrane sheet 23 as illustrated in FIG. 6. The buckling phenomenon of the disc spring 51 may also be referred to as a "reversal phenomenon" or a "snap buckling phenomenon".

The skirt part 53 of the disc spring 51 buckles when a certain load (about 0.6 N in the present embodiment) is applied to the disc spring 51, and due to the buckling, the pressed part 52 instantaneously moves in the pressing direction and presses the upper layer 24 as illustrated in FIG. 6.

Due to the buckling of the disc spring 51, when the key top 10 moves about 1.38 mm, the load on the key top 10 drastically decreases from the load (about 0.8 N) indicated by A1 to the load (about 0.6 N) indicated by A2 in FIG. 7.

The pressed part 52 reversed due to the buckling of the disc spring 51 presses the area 92 of the upper layer 24 of the membrane sheet 23 toward the lower layer 26. As a result, the upper layer 24 is deformed toward the lower layer 26, and the pair of the contact 27*a* of the lower electrode 27 and the contact 32*a* of the upper electrode 32 and the pair of the contact 28*a* of the lower electrode 28 and the contact 31*a* of the upper electrode 31 are connected, respectively, and the switch is turned on.

When the key top 10 is pressed further after the upper electrodes 31 and 32 are connected to the lower electrodes 27 and 28, the key top 10 moves further downward because the disc spring 51 can elastically deform slightly even after the buckling. When the key top 10 reaches a movement limit position of the key top 10 corresponding to a moved distance of about 1.83 mm (A3), the movement of the key top 10 is prevented also due to the presence of the disc spring 51.

When the force pressing the key top 10 is removed, the key top 10 moves in a direction opposite the pressing direction due to the restoring force of the elastically-deformed disc spring 51. Still, however, the disc spring 51 is in the buckled state until the key top 10 reaches a position (A4) corresponding to a moved distance of about 1.08 mm.

When the key top 10 reaches the position A4 corresponding to a moved distance of about 1.08 mm, the disc spring 51 is restored to its previous state before the buckling. When the disc spring 51 is restored to the previous state, the pressed part 52 returns to its original state and moves away from the upper layer 24. As a result, the pair of the contact 27*a* of the lower electrode 27 and the contact 32*a* of the upper electrode 32 and the pair of the contact 28*a* of the lower electrode 28 and the contact 31*a* of the upper electrode 31 are disconnected, respectively, and the switch is turned off.

Also, when the disc spring 51 is restored to the previous state, the load on the key top 10 increases as indicated by A5. Thereafter, the key top 10 moves upward due to the restoring force of the disc spring 51 and returns to a state before being pressed.

In the key switch 1 of the present embodiment, the area 92 of the upper layer 24 is pressed by a reversing force of the buckled disc spring 51 and the two pairs of contacts are thereby turned on.

Because the buckling of the disc spring 51 does not occur locally, the pressed part 52 reversed as a result of the buckling uniformly presses the entire area 92 of the upper layer 24. Also, the force with which the pressed part 52 presses the upper layer 24 is not the force with which the operator presses the key top 10, but is the reversing force generated when the disc spring 51 is reversed. As a result of the buckling of the disc spring 51, the pressed part 52 instantaneously moves downward and presses the upper layer 24. Accordingly, even if an off-center portion of the key top 10 is pressed by the operator, it does not affect the connection between the upper electrodes 31 and 32 and the lower electrodes 27 and 28. Further, different from a case where a rubber, cup is used, because the pressed part 52 of the buckled disc spring 51 is instantaneously reversed, the upper layer 24 is pressed by the pressed part 52 substantially at the same time as the disc spring 51 starts to buckle. This in turn makes it possible to simultaneously press and turn on two pairs of contacts immediately after the disc spring 51 starts to buckle, and thereby makes it possible to prevent the two pairs of contacts from being turned on at different timings.

As described above, the configuration of the key switch 1 of the present embodiment makes it possible to evenly and uniformly press the area 92 where the pair of the upper electrode 32 (the contact 32*a*) and the lower electrode 27 (the contact 27*a*) and the pair of the upper electrode 31 (the contact 31*a*) and the lower electrode 28 (the contact 28*a*) are formed, and thereby makes it possible to reliably turn on multiple pairs of contacts at the same time.

Next, variations of the upper electrode and the lower electrode of the key switch are described.

In the above example, each of the contacts 27*a*, 28*a*, 31*a*, and 32*a* of the electrodes 27, 28, 31, and 32 of the key switch 1 has a semicircular shape. However, the shape of the contacts of the upper electrodes and the lower electrodes is not limited to the semicircular shape, and other types of electrode patterns may be used.

Other examples of upper and lower electrode patterns are described below with reference to FIGS. 9 through 12. Because the shapes of upper electrodes are the same as the shapes of lower electrodes in each example, FIGS. 9 through 12 illustrate only upper electrode and only the upper electrodes are described below. The same reference numbers as those in FIGS. 1 through 4 are assigned to the corresponding components in FIGS. 9 through 12, and repeated descriptions of those components are omitted.

Figure 9:
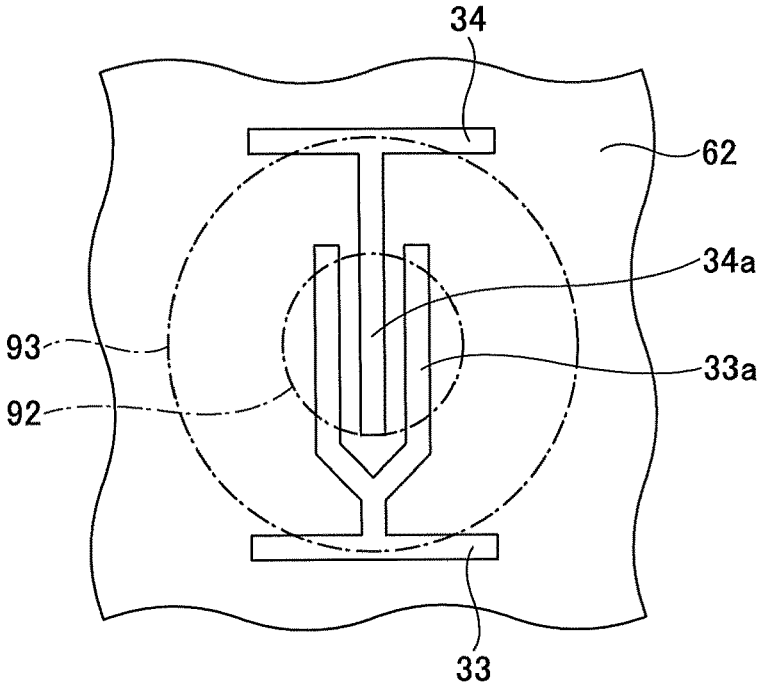
FIG. 9 is a drawing illustrating another electrode pattern.

An upper layer 62 in FIG. 9 includes an upper electrode 33 connected to the first control circuit 42 and an upper electrode 34 connected to the second control circuit 43.

Contacts 33*a* of the upper electrode 33 and a contact 34*a* of the upper electrode 34 are arranged alternately and extend parallel to each other in the area 92. The upper electrode 33 branches into two contacts 33*a*, and the contact 34*a* is disposed between the two contacts 33*a*.

Figure 10:
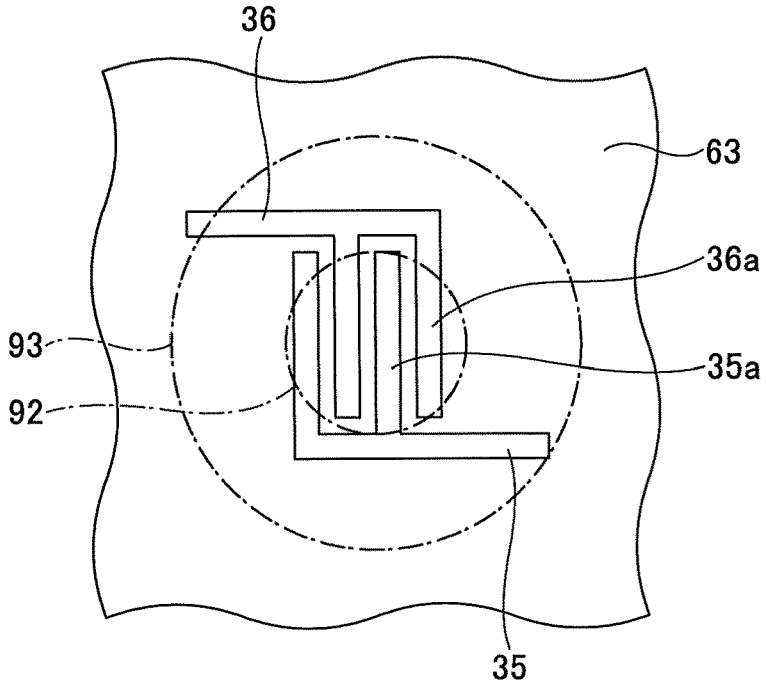
FIG. 10 is a drawing illustrating another electrode pattern.

An upper layer 63 in FIG. 10 includes an upper electrode 35 connected to the first control circuit 42 and an upper electrode 36 connected to the second control circuit 43.

The upper electrode 35 branches into two contacts 35*a*, and the upper electrode 36 branches into two contacts 36*a*. The contacts 35*a* and the contacts 36*a* are arranged alternately and extend parallel to each other in the area 92.

Figure 11:
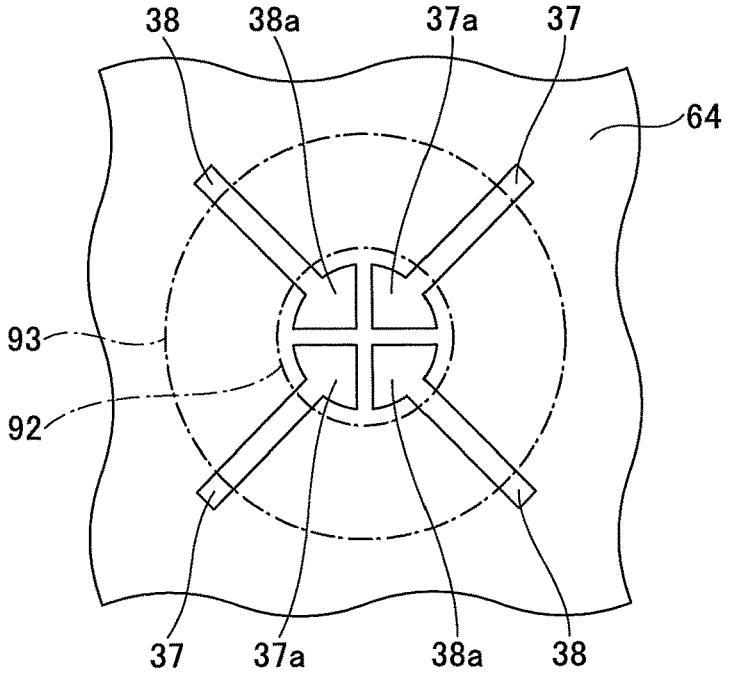
FIG. 11 is a drawing illustrating another electrode pattern.

An upper layer 64 in FIG. 11 includes two upper electrodes 37 connected to the first control circuit 42 and two upper electrodes 38 connected to the second control circuit 43.

The upper electrodes 37 and 38, respectively, include contacts 37*a* and 38*a* that have a fan-like shape in plan view. The contacts 37*a* and the contacts 38*a* are arranged alternately in the circumferential direction in the area 92. Also, the two contacts 37*a* are arranged to face each other across the center of the area 92, and the two contacts 38*a* are arranged to face each other across the center of the area 92.

Figure 12:
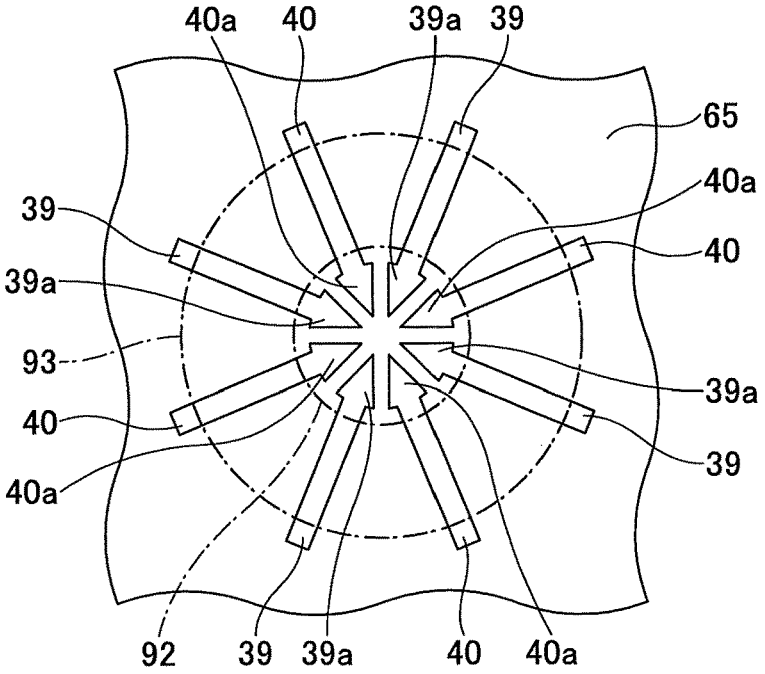
FIG. 12 is a drawing illustrating another electrode pattern.

An upper layer 65 in FIG. 12 includes four upper electrodes 39 connected to the first control circuit 42 and four upper electrodes 40 connected to the second control circuit 43.

The upper electrodes 39 include four contacts 39*a* shaped like an isosceles triangle, and the upper electrodes 40 include four contacts 40*a* shaped like an isosceles triangle. The contacts 39*a* and the contacts 40*a* are arranged alternately. Also, each pair of two contacts 39*a* in the four contacts 39*a* are arranged to face each other in the area 92, and each pair of two contacts 40*a* in the four contacts 40*a* are arranged to face each other in the area 92.

As illustrated in FIGS. 9 through 12, contacts of electrodes may have various shapes such as a fan-like shape and a triangular shape. Also, when multiple electrodes are connected to each of the first control circuit 42 and the second control circuit 43, contacts of the electrodes may be scattered or distributed within the area 92 instead of arranging the contacts next to each other as illustrated in FIGS. 4, 9, 10, 11, and 12.

Embodiments of the present invention are described above. However, the present invention is not limited to the specifically disclosed embodiments, and variations and modifications may be made without departing from the scope of the present invention.

Figure 13A:
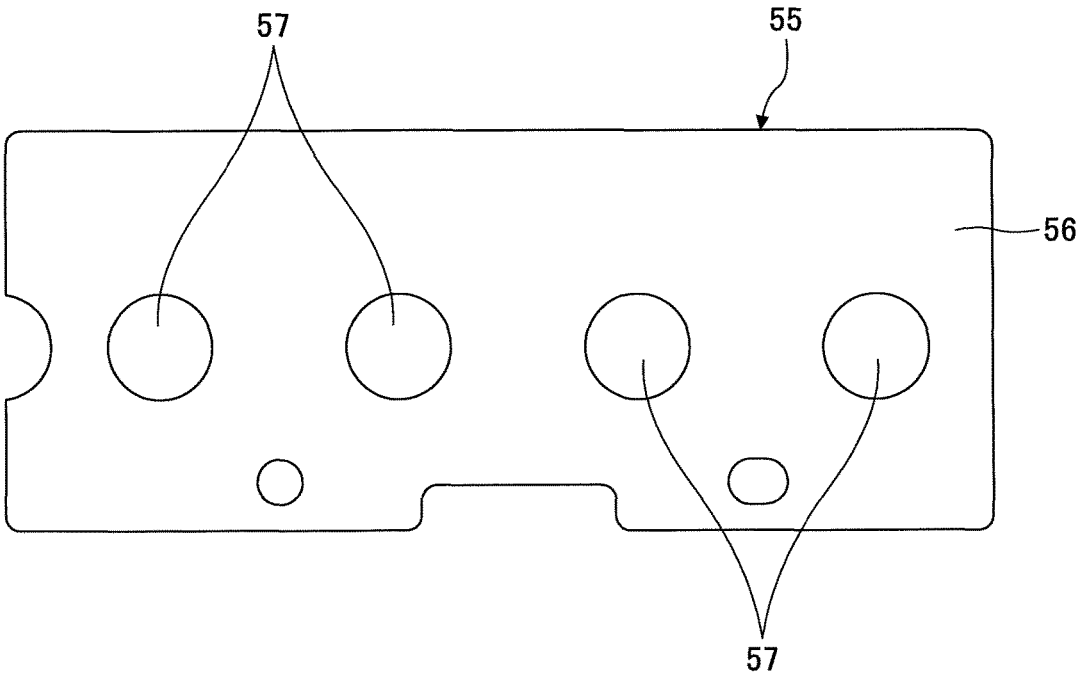
FIG. 13A is a drawing illustrating an embossed sheet.
Figure 13B:
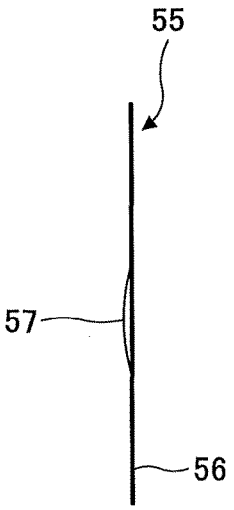
FIG. 13B is a drawing illustrating an embossed sheet.

In the key switch 1 of the above embodiment, the disc spring 51 is used as an elastic part disposed between the key top 10 and the membrane sheet 23. However, an embossed sheet 55 illustrated in FIGS. 13A and 13B may be used instead of the disc spring 51.

The embossed sheet 55 includes a sheet 56 and convex parts 57 formed on the sheet 56. Each convex part 57 buckles when pressed. Thus, the embossed sheet 55 can be used in place of the disc spring 51.

Also in the above embodiment, the gear link mechanism 13 is used as a support mechanism for supporting the key top. However, any other support mechanism such as a pantograph mechanism may be used to support the key top.

The key top 10 and the pressing part 10*a* are examples of a movable part.

The linking parts 11 and 12 and the frames 21*a* are examples of a support mechanism.

The membrane sheet 23 is an example of an electrical connector.

The disc spring 51 is an example of a disc spring.

Each of the upper layers 24, 62, 63, 64, and 65 is an example of an electrode sheet including a resin sheet on which upper electrodes are formed.

The lower layer 26 is an example of a printed-circuit board on which lower electrodes are printed.

The point at which the load indicated by A1 drastically decreases to the load indicated by A2 is an example of a load decreasing point at which the load of pressing the movable part first decreases after the movable part starts to be pressed.

The keyboard 100 is an example of a keyboard.

The present international application is based on and claims the benefit of priority of Japanese Patent Application No. 2015-133045 filed on Jul. 1, 2015, the entire contents of which are hereby incorporated herein by reference.

INDUSTRIAL APPLICABILITY

A keyboard and a key switch of the present embodiment may be used, for example, for a console panel of an industrial machine and an operations panel of medical equipment. Although the key switch of the present embodiment is included in a keyboard, the key switch of the present embodiment may be used for any apparatus that requires key input.

EXPLANATION OF REFERENCE NUMERALS

1 Key switch
10 Key top
10*a* Pressing part
11, 12 Linking part
21 Base
22 Support
23 Membrane sheet
24 Upper layer
26 Lower layer
27, 28 Lower electrode
31-40 Upper electrode
27*a*, 28*a*, 30*a*-40*a* Contact
41 Drive circuit
42 First control circuit
43 Second control circuit
51 Disc spring
52 Pressed part
53 Skirt part
55 Embossed sheet

The invention claimed is:

1. A key switch, comprising:

a movable part configured to be moved by a pressing operation;

a support mechanism that movably supports the movable part;

an electrical connector including multiple pairs of contacts of upper electrodes and lower electrodes; and a disc spring that is disposed between the movable part and the electrical connector and configured to be elastically deformed by movement of the movable part and to press the electrical connector, wherein the multiple pairs of contacts are provided for one movable part;

when the disc spring is deformed by the movement of the movable part, the disc spring is configured to simultaneously press the multiple pairs of contacts provided for the corresponding movable part; and the multiple pairs of contacts include a first contact pair including a first upper contact and a first lower contact that have a first semicircular shape and a second contact pair including a second upper contact and a second lower contact that have a second semicircular shape that is symmetric to the first semicircular shape, the first contact pair constituting a part of a first electric circuit and the second contact pair constituting a part of a second electric circuit that is independent of the first electric circuit.

2. The key switch as claimed in claim 1, wherein the electrical connector is a membrane sheet including an upper layer on which the upper electrodes are formed and a lower layer on which the lower electrodes are formed.

3. The key switch as claimed in claim 1, wherein the electrical connector includes an electrode sheet including a resin sheet on which the upper electrodes are formed, and a printed-circuit board on which the lower electrodes are printed.

4. The key switch as claimed in claim 1, wherein each of the multiple pairs of contacts is turned on when the movable part reaches a load decreasing point at which a load of pressing the movable part first decreases after the movable part starts to be pressed.

5. A keyboard, comprising:

a plurality of the key switches of claim 1.

* * * * *